US006824819B2

(12) United States Patent
Vogt et al.

(10) Patent No.: US 6,824,819 B2
(45) Date of Patent: Nov. 30, 2004

(54) WASH-DURABLE, DOWN-PROOFED METALLIZED FABRIC

(75) Inventors: Kirkland W. Vogt, Simpsonville, SC (US); Robert J. Goulet, Spartanburg, SC (US); Jimmie A. Still, Barnwell, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/252,475

(22) Filed: Sep. 23, 2002

(65) Prior Publication Data

US 2003/0027476 A1 Feb. 6, 2003

Related U.S. Application Data

(63) Continuation of application No. 09/400,511, filed on Sep. 20, 1999, now Pat. No. 6,191,056, and a continuation of application No. 09/148,182, filed on Sep. 4, 1998, now Pat. No. 6,242,369.

(51) Int. Cl.[7] ..... B32B 15/08; B05D 1/14

(52) U.S. Cl. ..... 427/203; 442/152; 442/153; 442/164; 442/228; 442/148; 442/93; 442/94; 8/495; 427/205; 427/214; 427/412

(58) Field of Search ..... 442/93, 94, 168, 442/148, 152, 153, 164, 228; 428/348; 8/495; 427/203, 205, 214, 412

(56) References Cited

U.S. PATENT DOCUMENTS

| | | | | |
|---|---|---|---|---|
| 3,660,138 | A | 5/1972 | Gorrell | |
| 4,390,588 | A | 6/1983 | Ebneth et al. | |
| 4,569,874 | A | 2/1986 | Kuznetz | |
| 5,178,938 | A * | 1/1993 | Magistro et al. | 442/261 |
| 5,271,998 | A | 12/1993 | Duckett | |
| 5,744,405 | A | 4/1998 | Okumura et al. | |
| 5,750,242 | A | 5/1998 | Culler | |
| 5,985,773 | A * | 11/1999 | Lee | 442/89 |
| 6,191,056 | B1 * | 2/2001 | Vogt et al. | 442/148 |
| 6,242,369 | B1 * | 6/2001 | Vogt et al. | 442/148 |

OTHER PUBLICATIONS

Fairchild's Dictionary of Textiles, 7th edition "encapsulation", p. 200, 1996.*

Fairchild's Dictionary of Textiles 7$^{th}$ Edition "encapsulation", p. 200. 1996.

* cited by examiner

*Primary Examiner*—Arti R. Singh
(74) *Attorney, Agent, or Firm*—Terry T. Moyer; Sara M. Current

(57) ABSTRACT

A washfast and down-proof metallized fabric which comprises a metallic side, a non-metallic side and a cross-linked polyurethane latex coating over both sides which encapsulates said metal particles, its method of preparation and articles of clothing comprising such fabric are described.

6 Claims, No Drawings

WASH-DURABLE, DOWN-PROOFED METALLIZED FABRIC

RELATED APPLICATIONS

This application is a continuing application of U.S. patent application Ser. No. 09/148,182, now U.S. Pat. No. 6,242,369 filed Sep. 4, 1998, and U.S. patent application Ser. No. 09/400,511 now U.S. Pat. No. 6,191,056, fled Sep. 20, 1999, the contents of which are incorporated herein in their entirety.

FIELD OF THE INVENTION

This invention relates to metallized fabrics which are durable to washing and wear. They can be used to down-proof articles in which they are used as linings, e.g., down and fiber filled, insulated articles of clothing and sleeping bags.

BACKGROUND OF THE INVENTION

Metallized fabrics are utilized to reflect radiant heat emitted by the body and thus provide effective heat insulation, particularly for outdoor use and in cold weather climates, e.g., winter apparel and sleeping bags.

U.S. Pat. No. 4,569,874 to Kuznetz discloses lightweight sportswear fabric for cold climates which comprises a composite fabric having vapor-permeable laminate formed by a core layer of hollow fibers acting as a thermal blanket between inner and outer skins. Both faces of the inner skin and the inside face of the outer skin are metallized to render them reflective while the outside face of the outer skin is blackened to absorb solar energy. Radiant heat from the wearer is reflected by the outside face of the inner skin while convection heat from the wearer's body passes by conduction through the inner skin of the laminate to be absorbed by the core layer. Solar heat absorbed by the blackened face is conducted through the outer skin to be absorbed by the core layer. Infrared energy loss from the core layer is minimized by internal reflection from the reflective inside faces of the skins.

U.S. Pat. No. 5,750,242 to Culler discloses a fabric which provides thermal image masking in mid and far infra-red region without compromising the effectiveness of visual and near IR camouflage or comfort level. The material incorporates a metallized microporous membrane into a typical article of clothing or covering, e.g., tents, which suppresses thermal imaging. An air permeable, moisture vapor transmitting, waterproof material having a metallized membrane is laminated to a textile backing and the metal in the metallized membrane forms a discontinuous layer at the surface and on the pore walls adjacent the surface of the microporous membrane. This provides an air permeable, vapor transmissive, waterproof material which suppresses thermal imaging of objects behind the metallized membrane.

U.S. Pat. No. 5,271,998 to Duckett discloses a lightweight metallized fabric which can be used in an automobile cover. The fabric is made by vacuum metallizing with aluminum and applying a finishing solution comprising a urethane, acrylic, fluorocarbon polymer emulsion, drying the fabric at 320° to 400° F. and optionally calendering the fabric after drying.

U.S. patent application Ser. No. 09/148,182, filed Sep. 4, 1998, (Case No. 2049) discloses a metallized fabric of improved washfastness which comprises discrete metal particles encapsulated within a cross-linked polyurethane latex. U.S. patent application Ser. No. 09/400,511, filed Sep. 20, 1999, (Case No. 2097) discloses a metallized fabric of improved washfastness which comprises discrete metal particles encapsulated within a cross-linked polyurethane latex, wherein the metal particles are treated with a primer coating composition comprising the reaction product of a copolymer comprising at least two different monomers: (i) a phosphate-containing vinyl monomer and (ii) a second, separate vinylic monomer containing at least one reactive group capable of covalently reacting with the cross-linking agent present within the polyurethane latex coating.

It would be desirable to provide insulated metallized fabric articles suited to use in cold weather applications such as insulated apparel, sleeping bags, etc. which comprise a fabric having a metal-coated side and an uncoated side which fabric is of improved washfastness. Moreover, it would be desirable to provide metallized fabric articles that do not allow the migration of natural and synthetic insulations, such as hollow fibers or down, through the fabric so as to contain the insulation within the article during normal use and washing.

SUMMARY OF THE INVENTION

In one aspect, the present invention relates to a durable, lightweight metallized fabric which can be used as a lining for insulated articles and which is resistant to migration of insulating materials through its thickness. The fabric comprises: a metallic side having a metal coating containing discrete metal particles, a non-metallic side, and a cross-linked polyurethane latex coating over both sides which encapsulates said metal particles. The fabric can be calendered to an extent sufficient to reduce migration of insulation through its thickness.

In another aspect, the present invention relates to a method of preparing a metallized fabric which comprises i) providing a fabric, ii) coating one side of said fabric with metal particles, iii) coating both sides of said fabric in a cross-linked polyurethane latex comprising a polyurethane dispersion, a cross-linking agent, an inhibitor, and optionally, a catalyst to initiate cross-linking of said polyurethane dispersion, to encapsulate said metal particles within said polyurethane latex; and iv) calendering said fabric to an extent sufficient to reduce migration of insulation through its thickness.

In yet another aspect, the present invention relates to an article of clothing containing insulation and having an interior lining of metallized fabric resistant to passage of said insulation through its thickness, which comprises a metallic side coated with metal particles, a non-metallic side, and a cross-linked polyurethane latex coating over both sides to encapsulate said metal particles within said polyurethane latex, wherein the metallic side faces a body surface of a wearer. The resistance of the fabric to passage of the insulation can be increased by calendering the metallized fabric.

DETAILED DESCRIPTION OF THE INVENTION

Without limiting the scope of the invention, the preferred embodiments and features are hereinafter set forth.

The present invention relates to a metallized fabric of improved washfastness which comprises a metallic side, a non-metallic side and a cross-linked polyurethane latex coating on both sides. The metallic side comprises a metal coating containing discrete metal particles encapsulated within the cross-linked polyurethane latex. The encapsulated metal coating serves to resist corrosion of the metal particles adhered to the fabric surface to substantially eliminate removal of such metal particles from the fabric substrate due to abrasion encountered during fabric use, atmospheric conditions and/or harsh laundering conditions.

Any fabric can be utilized in this invention provided that the polyurethane latex thoroughly coats the metal particulate coating of the fabric so as to substantially prevent contact between the metal and atmospheric oxygen or harsh oxidizing (and thus corrosive) chemicals present within laundry applications. Fabric comprising polyamide yarn, e.g., nylon, is most preferred. However, any natural fabrics such as cotton and ramie, or any synthetic fiber material such as, polyester, other polyamide, polypropylene, polyester-polyurethanes such as Lycra (Tradename), available from E. I. duPont deNemours and Company, Wilmington, Del., and the like; or any blends of synthetic fibers may be utilized within the inventive fabric. While plain weave construction is preferred, fabrics may be woven in plain, rip-stop, twill, satin or crepe constructions. The fabric yarns may range from single to double ply, 30 to 300 denier and 34 to 150 filaments. The preferred yarn in both the warp and filling direction is single ply, 40 denier with 34 filaments. It is preferred to use a flat warp yarn and textured filling yarn, but either type may be used in either the warp or filling. The preferred finished fabric yarn count when using 40 denier yarn is 170 warp yarns per inch and 140 filling yarns per inch. However, the warp yarn count when using 40 denier may vary from 80 to 200 and the filling from 80 to 200. Additionally, the yarn count can vary considerably depending on the yarn denier.

Prior to metallizing, the fabric can be scoured clean and dried. At this point, the fabric can be metallized, preferably with aluminum. This process includes applying a very thin layer of aluminum to a surface of the nylon fabric with a technique known to those of ordinary skill in the art of metallizing fabrics and film.

The preferred method of metallizing the fabric is by vacuum metal vapor deposition. However, metallizing of the fabric may be accomplished by any process which can be used to deposit metal onto a fabric and which bonds the metal to the fabric. The metallizing step may be carried out by other techniques such as metal sputtering, plasma treatments, electron beam treatments, chemical oxidation or reduction reactions, as well as currentless wet-chemical deposition.

The surface of the fabric may be modified by flame treatment, plasma discharge or corona discharge treatments to enhance adhesion of the metallic coating to the fabric before the metallizing step and/or before the encapsulation process to enhance adhesion of the polyurethane to the fabric.

Any metal generally utilized within a coating for fabrics may be utilized within this invention. The most common metal for this purpose, aluminum, is preferred because of its low cost and superior performance characteristics including radiant heat reflection in cold weather fabrics. Other metals which may be utilized include copper, gold, silver, nickel, zinc, titanium, chromium, vanadium and the like.

The metal layer on the fabric substrate in this invention preferably comprises aluminum, deposited by a vacuum deposition technique on the fabric substrate, with a thickness lying in the range of from 200 to 300 angstroms, i.e. 20 to 30 nm. This metallizing process is available from various vendors, including Diversified Fabrics of Kings Mountain, N.C. and National Metalizing of Cranberry, N.J.

The present invention utilizes a polyurethane latex over the metal coating of the target fabric to provide a barrier to corrosive elements resulting in a long-lasting radiant heat reflecting fabric.

The polyurethane component can be a waterborne aliphatic or aromatic polymer which provides a soft hand to the fabric substrate. As such, the preferred polyurethane is a dispersion comprising a polyurethane having an elongation of at least 150% and, conversely, a tensile strength up to 7000 psi. Particular examples of such dispersions include those within the Witcobond (Tradename) polyurethane series, from Witco Corporation, New York, N.Y., such as W-232, W-234, W-160, W-213, W-236, W-252, W-290H, W-293, W-320, and W-506, with W-293 being especially preferred. Acrylic polyurethane dispersions may also be utilized provided they exhibit the same required degree of elongation and tensile strength as for the purely polyurethane dispersions.

Any cross-linking agent compatible with polyurethanes may be utilized within this invention, particularly those which have low amounts of free formaldehyde. Preferred as cross-linking agents are Cytec (Tradename) M3 and Aerotex (Tradename) PFK, both available from BFGoodrich Co., Akron, Ohio. Any catalyst, which is generally necessary to initiate and effectuate cross-linking of a polyurethane dispersion, which is compatible with both a polyurethane and a polyurethane cross-linking agent may be utilized within this invention, e.g., Cytec (Tradename) MX, available from BFGoodrich Co.

Adhesion promoters which serve to promote adhesion between the aluminum and the polyurethane can also be present in the cross-linked polyurethane latex. Such adhesion promoters include polymers selected from the group consisting of silanes and phosphates. An adhesion promoter phosphate polymer can be applied in 0.1-1.0% percent add-on the weight of the fabric (owf). Amino-silane compounds available from Gelest in Tullyton, Pa. can be used in the 0.1-2.0% add-on owf.

The cross-linked polyurethane latex of the invention may be present in any amount and concentration within an aqueous solution for use on and within the target fabric. Table 1 below indicates the difference in performance of the cross-linked polyurethane latex in reference to its concentration and dry solids addition rate on the fabric surface. Preferably, the concentration of the polyurethane is from 5 to 100% by weight of the utilized aqueous solution; more preferably from 10 to about 75% by weight; and most preferably from 25 to about 50% by weight. The coating addition rate measured as the percent of dry solids addition owf of the cross-linked polyurethane dispersion is preferably from 3 to 50% owf; more preferably from about 6 to about 40% owf; and most preferably from about 15 to about 30% owf, say about 10%.

As noted below, the basic procedure followed in applying this cross-linked polyurethane dispersion entails first providing a metal-coated fabric. Next, the latex is formed by combining the polyurethane with the cross-linking agent and, optionally, a catalyst to effectuate such cross-linking of the polyurethane. The resultant latex is then diluted with water to the desired concentration which will provide the most beneficial washfastness of the metal coating after treatment. The metal-coated fabric is then saturated with the resultant aqueous solution of the polyurethane latex with the excess being removed. Such saturation and removal of the latex may be performed in any standard manner, including dipping, padding, immersion, and the like for initial contacting of the dispersion; and wringing, drying, padding, and the like for the removal of the excess. The treated fabric is then dried and cured for a period of time, preferably at a temperature sufficient to effectuate a complete covering of the metal particles previously adhered to the target fabric surface. For example only, a temperature between about 300° and 450° F.; preferably between 310° and 400° F.; more preferably from 325° and 385° F.; and most preferably between 350° and 370° F. are workable. Times of from 2 to 30 minutes are preferred for this drying and curing step with a time between about 2 and 10 minutes most preferred.

Any other standard textile additives, such as dyes, sizing compounds, and softening agents may also be incorporated within or introduced onto the surface of the apparel fabric substrate. Particularly desired as optional finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture.

The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference.

Another significant characteristic of this fabric is its ability to prevent migration of insulating materials, feathers, down, and synthetic fibers, through the fabric's thickness. The ability of the fabric to prevent the migration of insulating materials is maximized when the voids at the interstices between overlapping yarns in the fabric are minimized and is achieved in this fabric through a combination of high yarn count construction, polyurethane coating, and calendering. Evaluating the ability of the fabric to prevent insulation migration was achieved using Federal Standard 191, Test Method 5450 (ASTM standard D737). A reduction in air permeability directly relates to a reduction in insulation migration through the fabric. To further reduce air permeability, a number of approaches have been taken. U.S. Pat. Nos. 5,073,418 to Thornton et al.; 5,011,183 to Thornton et al.; 4,977,016 to Thornton et al.; and U.S. Pat. No. 4,921,735 to Bloch, all of which are incorporated herein by reference, disclose providing low permeability characteristics through the use of mechanical deformation processes, e.g., calendering, to close the voids at the interstices between overlapping yarns in the fabric. Calendering of the present fabric may be carried out at any suitable point in its manufacture, e.g., prior to coating with metal particles, after metallizing but before treatment with polyurethane latex, or after such treatment.

Preferably, the metallized fabric of the present invention has an air permeability of not greater than 5 and not less than 1 cubic feet per minute (cfm) per square foot of fabric at a differential pressure of water at 125 Pascals of differential pressure, when measured in accordance with Federal Test Method 5450. Most preferably, the air permeability is equal to about 3 cfm, to allow some air flow through the fabric so that the insulating materials can dry after exposure to moisture, yet prohibit the migration of insulation, e.g., down, through the fabric.

The fabrics of the present invention are particularly well suited as inner-layer barrier fabrics such as liners for cold weather garments, pillows, sleeping bags, comforters and disposable industrial garments (e.g., protective and medical barrier apparel), due to their ability to 1) retain a substantial amount of metal particles within and on the target fabric after a long duration of wear and repeated standard launderings; 2) retain a substantial amount of heat due to the presence of a large amount of heat-reflecting metal particles within and on the target fabric; and 3) prohibit the migration of insulating materials, e.g., feathers, down and synthetic materials such as hollow fibers, through the fabric.

DESCRIPTION OF THE PREFERRED EMBODIMENT

The following examples are indicative of the preferred embodiment of this invention:

EXAMPLE 1

Shows Function of the Coating and Level

A 100% polyester, 4×1 sateen woven fabric (115/34 warp-drawn warp yarn and 150/50 textured fill yarn, having a fabric weight of 3.5 ounces per square yard) was evaporation-coated with 0.24 wt. % of aluminum produced by Diversified Fabrics, Inc. of Kings Mountain, N.C. A latex mixture of 100 grams of Witcobond® W-293, available from Witco of Chicago, Ill., 1 gram of Cytec M3 (crosslinking agent), available from of BF Goodrich of Charlotte, N.C., and 1 gram of Cytec MX (cross-linking catalyst), available from BF Goodrich of Charlotte, N.C., were then blended together in a beaker. This mixture was then diluted with water to varying concentrations as set forth in the Table below. Different swatches of the aluminum-coated fabric were then saturated with these various polyurethane latex mixtures and squeezed between two wringers in order to remove excess latex. Each fabric sample was then dried and cured at 360° F. for about 5 minutes. Each treated swatch was then washed according to AATCC Test Method 130-1995, "Soil Release: Oily Stain Release Method" and measured for aluminum retention after different numbers of washes. The washfastness of the latex encapsulated remaining aluminum was calculated through the utilization of a % ash test according to AATCC Test Method 78-1989, "Ash Content of Bleached Cellulosic Textiles."

TABLE 1

| Latex Concentration (wt. % of aqueous soln.) | Coating Addition Rate (% dry solids add'n owf) | Washfastness (% Al remaining after X washes) | | |
|---|---|---|---|---|
| | | X = 3 | X = 10 | X = 20 |
| 0 | 0 | 2.3 | 4.5 | 4.5 |
| 2.5 | 1.7 | 22.7 | 11.4 | 6.8 |
| 5.0 | 3.3 | 31.8 | 27.3 | 27.3 |
| 10.0 | 6.0 | 65.9 | 43.2 | 40.9 |
| 15.0 | 8.3 | 68.2 | 59.1 | 45.5 |
| 25.0 | 15.0 | 88.6 | 75.0 | 75.0 |
| 50.0 | 26.7 | 90.9 | 86.4 | 86.4 |
| 75.0 | 36.0 | 86.4 | 77.3 | 72.7 |
| 100 | 49.0 | 86.4 | 84.1 | 84.1 |

As is clearly evident, the washfastness of the aluminum improved dramatically first upon utilization of the cross-linked polyurethane encapsulate, and second, upon utilization of greater concentrations of the latex up to a 50% by weight concentration of the cross-linked latex in aqueous solution.

EXAMPLE 2

Shows Function of the Adhesion Promoter

A 100% Nylon 66, plain weave, woven fabric (1/40/34 flat warp yarn and 1/40/34 textured fill yarn, having a fabric weight of 1.8 ounces per square yard) was vacuum metal vapor deposited on one side of the fabric with 0.32 wt. % of aluminum produced by Diversified Fabrics, Inc. of Kings Mountain, N.C. A latex mixture of 42% Witcobond® W-293, available from Witco of Chicago, Ill., 1.3% Freerez PFK, available from of Freedom Textile Company of Charlotte, N.C., 0.3% Cytec MX cross-linking catalyst, available from BFGoodrich of Charlotte, N.C., 0.2% Syn-Fac™ TDA-92, available from Milliken Chemical of Spartanburg, S.C., and 0.4% ammonia was blended in a beaker. Another identical latex mixture was made to which 0.3% phosphate containing adhesion promoter was added. The promoter is a copolymer which is comprised of at least two different monomers: (i) a phosphate-containing vinyl monomer, i.e., ethylene methacrylate phosphate (available from Albright & Wilson, Birmingham, UK, under the tradename Epicryl™ 6835) and (ii) a second, separate vinylic monomer containing at least one reactive group capable of covalently reacting with the cross-linking agent present within the polyurethane latex coating, i.e., N-methylolacrylamide (available from Cytec Industries, West Paterson, N.J., under the tradename Cylink® NMA. The first and second monomers are added in a ratio of 0.8:1 to about 1:0.8.

Fabric samples were then dipped into each solution and pressed between two pad rollers to achieve a 30% addition of coating. The polyurethane latex was observed to actually encapsulate the entire bundle, including metal particles. The fabrics were then dried and cured at 360° F. for 3 minutes. A sample of fabric that was only metallized and a sample of metallized fabric that was dipped into each of the two latex coating systems were washed according to AATCC Test Method 130-1995, "Soil Release: Oily Stain Release Method" and measured for aluminum retention through 5 wash cycles. The washfastness of the remaining aluminum on each of the samples was calculated through the utilization of a % ash test according to AATCC Test Method 78-1989, "Ash Content of Bleached Cellulosic Textiles." The results were tabulated as follows in Table 2 below.

TABLE 2

| | Washfastness (% Al remaining after X washes) | | |
|---|---|---|---|
| X = Number of Washes | Metallized Only | Latex Coated | Latex w/Adhesion Promoter |
| X = 0 | 100 | 100 | 100 |
| X = 1 | 0 | 69 | 78 |
| X = 2 | 0 | 50 | 63 |
| X = 3 | 0 | 44 | 63 |
| X = 4 | 0 | 31 | 60 |
| X = 5 | 0 | 25 | 60 |

As is clearly evident, the washfastness of the aluminum improved dramatically first upon utilization of the cross-linked polyurethane encapsulate, and second, upon the addition of an adhesion promoter.

EXAMPLE 3

Shows Function of Calendering

The fabric of Example 2 with the cross-linked polyurethane encapsulate and the adhesion promoter is used as the inner layer (lining) of an insulated cold weather jacket containing a thermal insulation core of down insulation or hollow synthetic fibers of synthetic plastic material such as Thinsulate (Tradename) or Hollofil (Tradename) which act to trap air and minimize convective heat. The metallic layer is positioned in the garment to face the exterior body surface of the wearer. The use of this fabric as a lining fabric requires it to prohibit the migration of insulating materials through the fabric.

The outer layer may be a porous, non-woven fabric formed of polyester or other synthetic fibers that may or may not be laminated to a film to improve water proofness and breathability, such as Goretex (Tradename) fabric available from W. L. Gore and Associates, Elkton, Md.

The ability to resist the migration of insulating materials through the lining fabric is achieved through construction, the polyurethane latex and calendering. The fabric of Example 2 with the cross-linked polyurethane encapsulate and the adhesion promoter was calendered during the final processing step at various temperatures and pressures. The results of said testing are provided in Table 3 below.

TABLE 3

| | Air Permeability As measured by Federal Method 191–5450 | | |
|---|---|---|---|
| Calender | Calender Pressure | | |
| Temperature | 800 psi | 1000 psi | 1200 psi |
| 200° F. | 12.4 | 9.8 | 8.1 |
| 250° F. | 10.2 | 8.1 | 7.6 |
| 300° F. | 7.6 | 6.8 | 5.1 |
| 350° F. | 5.6 | 4.1 | 3.1 |
| 400° F. | 2.1 | 1.9 | 1.4 |

As is clearly evident, the ideal air permeability (3 cfm at 125 pascals of differential pressure) was achieved at 350° F. and 1200 psi.

There are, of course, many alternative embodiments and modifications of the present invention, which are intended to be included within the spirit and scope of the following claims.

It is claimed:

1. A method of preparing a metallized fabric which comprises i) providing a fabric, ii) coating one side of said fabric with metal particles, iii) coating both sides of said fabric with a cross-linked polyurethane latex comprising a polyurethane dispersion, a cross-linking agent, an inhibitor, and optionally, a catalyst to initiate cross-linking of said polyurethane dispersion, to encapsulate said metal particles within said polyurethane latex.

2. The method of claim 1 wherein said polyurethane latex comprises a polyurethane dispersion having an elongation of at least 150%, said cross linking agent is a primer coating composition comprising the reaction product of a copolymer comprising at least two different monomers: (i) a phosphate-containing vinyl monomer, and (ii) a second, separate vinylic monomer containing at least one reactive group capable of covalently reacting with the cross-linking agent present within the polyurethane latex coating, and said coating with metal particles is carried out by a technique selected from the group consisting of vacuum metal vapor deposition, metal sputtering, plasma treatment, electron beam treatment, chemical oxidation reaction, chemical reduction reaction, and currentless wet-chemical deposition.

3. The method of claim 1 which further comprises calendering said fabric prior to said coating with metal particles.

4. The method of claim 1 wherein said fabric is selected from the group consisting of polyester, polyamide, cotton and ramie and is further selected from the group consisting of woven fabric, knitted fabric and non-woven fabric, and said metal is selected from the group consisting of aluminum, copper, gold, silver, nickel, zinc, titanium, chromium, and vanadium.

5. The method of claim 1 wherein said metallized fabric has an air permeability not greater than 5 cubic feet per minute per square foot of fabric at 0.5 inches or water at 125 Pascals of differential pressure.

6. The method of claim 1 wherein said fabric is a woven fabric and wherein said polyurethane latex is catalytically cross-linked.

* * * * *

UNITED STATES PATENT AND TRADEMARK OFFICE

CERTIFICATE OF CORRECTION

PATENT NO. : 6,824,819 B2
DATED : November 30, 2004
INVENTOR(S) : Goulet et al.

It is certified that error appears in the above-identified patent and that said Letters Patent is hereby corrected as shown below:

Column 10,
Line 3, delete “or” and insert -- of -- after “inches”

Signed and Sealed this

Tenth Day of May, 2005

JON W. DUDAS
*Director of the United States Patent and Trademark Office*